US006983518B2

(12) United States Patent
Chen

(10) Patent No.: US 6,983,518 B2
(45) Date of Patent: Jan. 10, 2006

(54) BUCKLE FOR BELTS

(75) Inventor: Shun-Min Chen, Taipei Hsien (TW)

(73) Assignee: Wonderland Nurserygoods Co., Ltd., (TW)

( * ) Notice: Subject to any disclaimer, the term of this patent is extended or adjusted under 35 U.S.C. 154(b) by 29 days.

(21) Appl. No.: 10/679,024

(22) Filed: Oct. 3, 2003

(65) Prior Publication Data

US 2005/0071963 A1 Apr. 7, 2005

(51) Int. Cl.
*A44B 11/25* (2006.01)

(52) U.S. Cl. ..... 24/636; 24/633

(58) Field of Classification Search ..... 24/636, 24/637, 633, 641

See application file for complete search history.

(56) References Cited

U.S. PATENT DOCUMENTS

| | | | | |
|---|---|---|---|---|
| 2,862,268 A | * | 12/1958 | Cushman | 24/636 |
| 4,060,879 A | * | 12/1977 | Takada | 24/637 |
| 4,182,008 A | | 1/1980 | Pouget | |
| 4,451,958 A | * | 6/1984 | Robben et al. | 24/636 |
| 5,142,749 A | * | 9/1992 | Biller | 24/636 |
| 5,165,150 A | | 11/1992 | van Reisen | |
| 5,566,431 A | * | 10/1996 | Haglund | 24/633 |
| 2003/0111836 A1 | | 6/2003 | Tajima et al. | |

FOREIGN PATENT DOCUMENTS

| | | |
|---|---|---|
| EP | 0114332 | 8/1984 |
| EP | 1219197 | 7/2002 |
| GB | 2039590 | 8/1980 |
| JP | 07275013 | 10/1995 |

* cited by examiner

*Primary Examiner*—Robert J. Sandy
(74) *Attorney, Agent, or Firm*—Gauthier & Connors LLP

(57) ABSTRACT

A buckle for belts comprises a first shell unit having a releasing piece, a second shell unit connected under the first shell unit, a locking element pivotally connected to a seat of the second shell element, and a moving element movably installed behind the locking element. When a strap-connecting element is inserted into the buckle from a front end thereof, the locking element is pushed and is pivotally rotated by the strap-connecting element to make the locking element lock the strap-connecting element. Simultaneously, the moving element is moved to support the locking element so that the state of the locking element firmly securing the strap-connecting element is maintained. When the releasing piece of the first shell unit is actuated, the moving element is cooperated by the releasing element and no longer supports the locking element to release the state of the engagement between the locking element and the strap-connecting element.

17 Claims, 3 Drawing Sheets

BUCKLE FOR BELTS

FIELD OF THE INVENTION

The present invention relates generally to a buckle for belts, and more particularly to a buckle for belts having a locking element which is supported by a moving element to firmly lock a strap-connecting element.

BACKGROUND OF THE INVENTION

The conventional buckle for the safety belt, such as shown in U.S. Pat. No. 5,165,150, is further required the functions of simple structure, low cost, easy operation, and firm engagement, in addition to the basic functions of connecting and securing the safety belt. However the designs of the conventional buckle about all above aspects are not perfect and still remain some space to be filled up.

SUMMARY OF THE INVENTION

Accordingly, the present invention relates to a buckle for belts that can substantially obviate one or more of the problems due to the limitations and disadvantages of the related arts.

One object of the present invention is the provision of a buckle for belts whose structure is simple.

Another object of the present invention is the provision of a buckle for belts whose cost is low.

A further object of the present invention is the provision of a buckle for belts which is easily operated.

A yet object of the present invention is the provision of a buckle for belts which can firmly lock the straps.

Additional features and advantages of the invention will be set forth in the description which follows, and in portion will be apparent from the description, or may be learned by practice of the invention. The objectives and advantages of the invention will be realized and attained by the structure particularly pointed out in the written description and claims hereof as well as the appended drawings.

To achieve these and other advantages and according to the purpose of the present invention, as embodied and broadly described, a buckle for belts for connecting a strap-connecting element, the buckle comprising a first shell unit having a releasing piece; a second shell unit having a first end and a second end opposing the first end connected to the first shell unit and defining an entrance at the first end together with the first shell unit, the second shell unit further having a slit at the second end for connecting a belt and a seat situated between the entrance and the slit; a locking element pivotally connected to the seat of the second shell unit and has a latch adjacent the entrance, a ledge extending towards the slit, and a shoulder formed between the latch and the ledge; an elastic element is provided at the seat for repositioning the locking element; a moving element is movably installed between the seat and the slit such that the moving element is able to slide relative to the seat; and the buckle is designed such that when the strap-connecting element is inserted into the entrance between the first shell unit and the second shell unit, the shoulder is pushed by the strap-connecting element so that the locking element is pivotally rotated to make the latch lock the strap-connecting element to enlarge a gap between the ledge and a main body of the second shell unit such that the moving element is moved in the gap to contact with the ledge so as to keep the locking element in a state of firmly securing the strap-connecting element; when the releasing piece of the first shell unit is actuated, the releasing piece cooperates with the moving element to move the moving element out of the gap away from the ledge such that the elastic element repositions the locking element to release the latch from the state of locking the strap-connecting element.

It is preferred that the buckle has an elastic element between the moving element and the second shell unit to cooperate the moving element to abut against the ledge.

It is preferred that the releasing piece has at least a guiding tab for cooperating the moving element to escape from the ledge.

It is preferred that the first shell unit further has a cap and a perforation in the cap, and the releasing piece is accommodated in the perforation.

It is preferred that the releasing piece has a protrusion at an end of the at least the guiding tab for securing the releasing piece and the cap together.

It is preferred that the first shell unit has an elastic element between the cap and the releasing piece for reposition of the releasing piece.

It is preferred that the seat further comprises two parallel plates, and the buckle further has a pin for pivotally connecting the locking element to the two plates.

It is preferred that the buckle further has an elastic element at the seat for reposition of the locking element.

It is preferred that the buckle further has a pushing element near the entrance to push the strap-connecting element out of the buckle.

It is preferred that the second shell unit further has a base and a main body, and the base has a plurality of costas to secure the main body.

It is preferred that the seat and the slit are at the main body.

It is preferred that the moving element has at least a guider for the seat to guide the movement of the moving element.

It is preferred that the moving element has a spacer for abutting the ledge of the locking element to make the locking element firmly lock the strap-connecting element.

It is preferred that the second shell unit has at least a stud for abutting one end of the elastic element.

It is preferred that the moving element has at least a tunnel for receiving another end of the elastic element.

It is preferred that the second shell unit comprises a base and a main body, and the main body further has at least an orifice for the passing of the at least the stud to secure the base and the main body together.

It is preferred that the second shell unit has at least a stake for connecting the pushing element. It is to be understood that both the forgoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a portion of the specification, illustrate embodiments of the invention and together with the description serve to explain the principle of the invention. In the drawings.

DETAILED DESCRIPTION OF THE INVENTION

Figure 1:
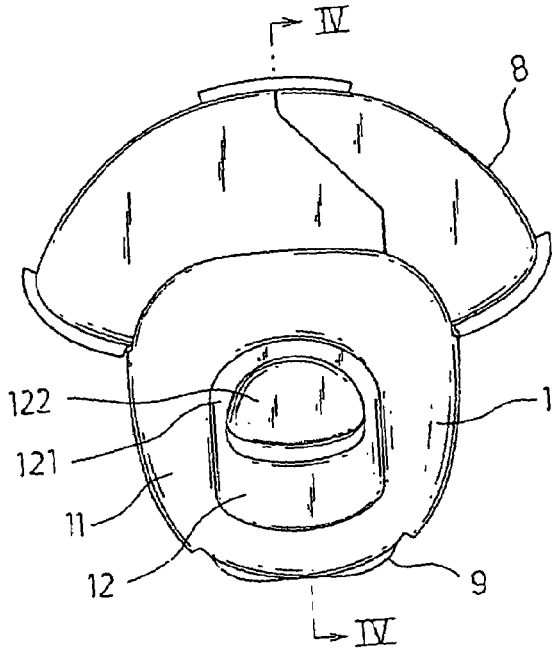
FIG. 1 is a top plane view illustrating that a strap-connecting element is engaged with the buckle according to the present invention.
Figure 3:
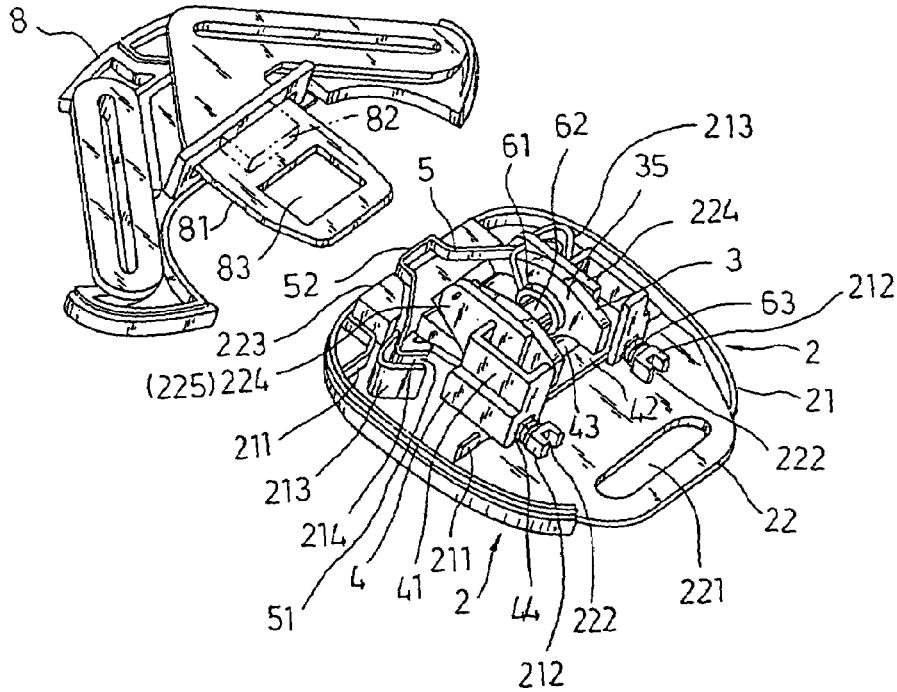
FIG. 3 is a perspective view illustrating that the buckle is separated from the strap-connecting element but not illustrating the first shell unit of the buckle and a cover of the strap-connecting element.
Figure 2:
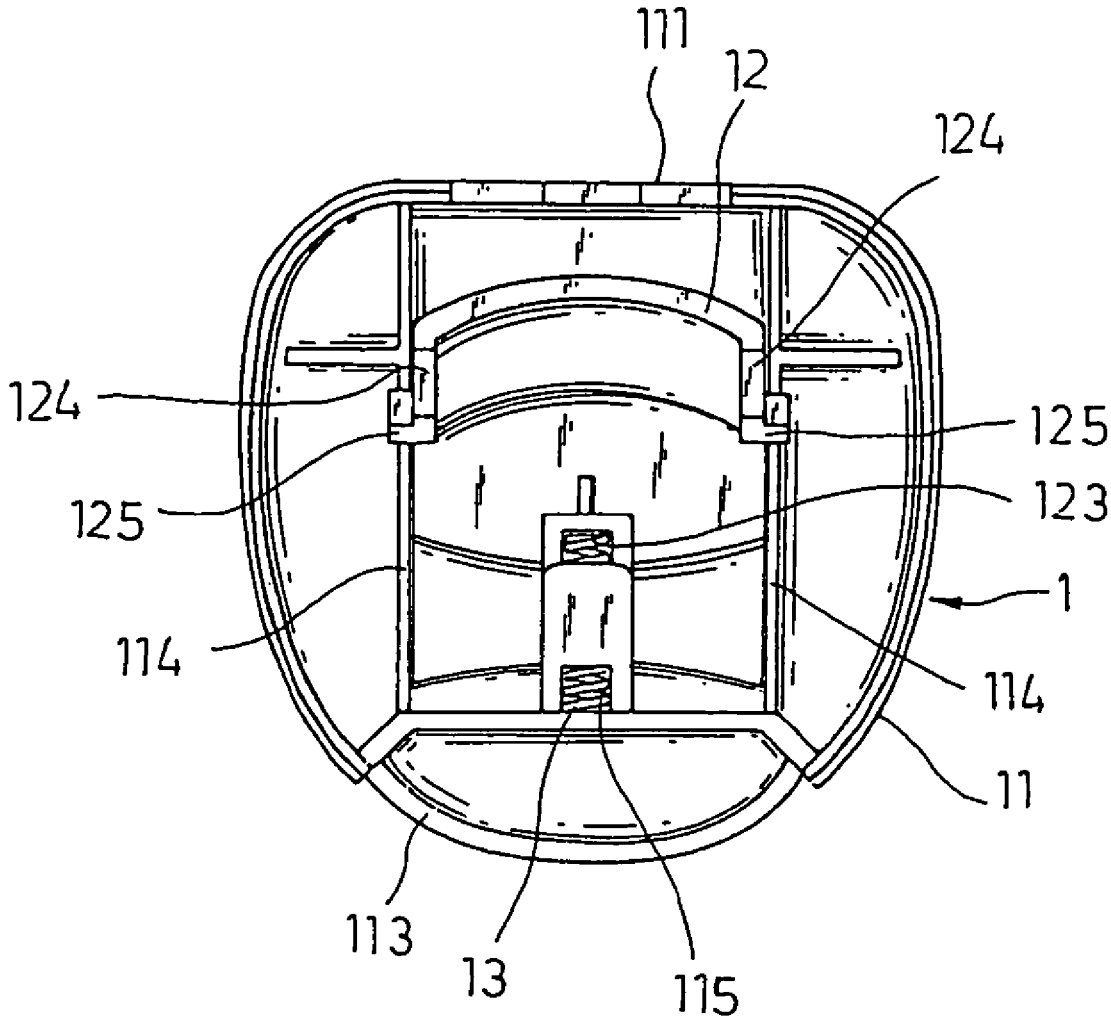
FIG. 2 is an assembled bottom plane view illustrating a first shell unit of the buckle according to the present invention.

As shown in FIGS. 1, 2 and 3, a buckle 9 for straps according to a preferred embodiment of the present invention comprises an upper first shell unit 1 and a lower second shell unit 2 as well as a locking element 3, a moving element 4, and a pushing element 5 which are interposed between the first shell unit 1 and the second shell unit 2.

The first shell unit 1 includes a cap 11, a releasing piece 12 mounted to the cap 11, and a first elastic member 13 interposed between the cap 11 and the releasing piece 12.

The cap 11 has a stepped first snick at the front end thereof, a perforation 112 (shown in FIG. 5) at the middle portion thereof, a second snick 113 at the rear end thereof. In addition, the cap 11, in the interior, also has two longitudinal ribs 114 parallel to each other, and a first slot 115 adjacent to the second snick 113 and between the two ribs 114.

The releasing piece 12, at the exterior, has a ring of flange 121 and recess 122 defined by the flange 121. In the interior, the releasing piece 12 also has a longitudinal second slot 123 at the central portion, two triangular guiding tabs 124 respectively extended from two sides of the releasing piece 12, and two protrusions 125 respectively protruding outwardly from the distal ends of the guiding tabs 124.

The assembly of the first shell unit 1 is completed by first putting the first elastic member 13 with one end thereof into the first slot 115 of the cap 11, then inserting the releasing piece 12 with two guiding tabs 124 into the perforation 112 and simultaneously setting another end of the first elastic member 13 into the second slot 123 of the releasing piece 12, and finally snapping the protrusions 125 of the guiding tabs 124 with the ribs 114 of the cap 11 respectively.

Because the protrusions 125 are engaged with the ribs 114 of the cap 11, the releasing piece 12 cannot automatically separate from the cap 11. Due to the guidance of the guiding tabs 124 and the ribs 114, the releasing piece 12 can longitudinally slide relative to the cap 11. However, when the releasing piece 12 is exerted only by the restoration force of the first elastic member 13 and by no other external force, the releasing piece 12 is in a normal state that the front end of the flange 121 is abutted against the front edge which defines the perforation 112. On the contrary, when the releasing piece 12 is exerted by an external force on the recess 122 or on the flange 121, the releasing piece 12 backwardly slides relative to the cap 11, which results in the first elastic element 13 being further compressed. After the external force disappears, the releasing piece 12 is pushed by the restoration force of the first elastic member 13 and thus forwardly moves to the position that the flange 121 is abutted against the front edge around the perforation 112 again.

The second shell unit 2 includes a base 21 made of, for example, plastic material and a main body 22 made of high strength material like metal.

The base 21 has costas 211 respectively situated at the front and middle portions, two studs 212 at the rear portion, two stakes 213 at the front portion, and two grooves 214 respectively situated on the stakes 213.

The main body 22 has a slit 221 and two rectangular orifices 222 at the rear section thereof, an inlet 223 at the front section thereof, and a seat 225 constructed by two parallel plates 224 at the middle section thereof. Each plate 224 has a hole 226 at the central part and an aperture 227 at the upper-front corner.

The assembly of the second shell unit 2 is accomplished by respectively inserting the two studs 212 through the two orifices 222 of the main body 22 and at the same time respectively abutting the edges of main body 22 against the costas 211 of the base 21 to secure the main body 22 to the base 21. In another preferred embodiment, the main body 22 and the base 21 can be integrally formed as the second shell unit 2.

The hollow and curved locking element 3 has a latch 31 at the lower-front corner thereof, a ledge 32 at the rear end, a shoulder 33 near the bottom thereof between the latch 31 and the ledge 32, two bores 34 respectively at the center of two side walls thereof, and an upwardly-opened cavity 35 between the two side walls.

The locking element 3 is mounted to the second shell unit 2 as follow. First, the locking element 3 is interposed between the two plates 224 of the seat 225. Secondly, a second elastic element 61, such as a spring, is placed in the cavity of the locking element 3 and two ends of the second elastic element 61 are respectively inserted into the apertures 227 in the two plates 224. Next, a pin 62 sequentially passes through the holes 226 of the plates 224, the bores 34 of the locking element 3, and the second elastic element 61 so as to pivotally secure the locking device 3 and the second elastic element 61 to the seat 225.

The U-shaped moving element 4 has two guiders 41 respectively at two sides, a spacer 42 connecting the two guiders 41, and an opening 43 defined by the guiders 41 and the spacer 42. Each guider 41 has a blind tunnel 44 which is closed at one end thereof.

The moving element 4 is mounted to the second shell unit 2 as follows. First, two third elastic elements 63, with one end thereof, are respectively inserted into the blind tunnels 44. Then, the moving element 4 is mounted to the second shell unit 2 in the manner that the seat 225 of the main body 22 is received in the opening 43 of the moving element 4. At this time, another ends of third elastic elements 63 are respectively abutted against the two studs 212 of the base 21, and the spacer 42 of the moving element 4 is behind the ledge 32 of the locking element 3 as well as the inner surfaces of the two guiders 41 are abutted against the outer surfaces of the two plates 224 in the seat 225 to guide the sliding of the moving element 4 relative to the seat 225.

Two lateral ends 51 of a pushing element 5 with elasticity are respectively accommodated in the grooves 214 of the stake 213 and the front end 52 of the pushing end 52 is placed above the inlet 223 of the main body 22.

Figure 4:
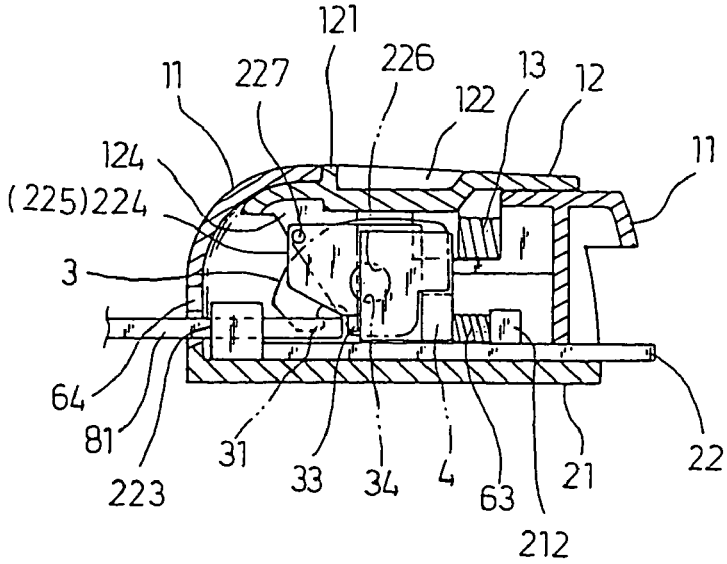
FIG. 4 is a sectional view of the buckle taken along line IV—IV in FIG. 1 and only the first shell unit instead of the second shell unit is cut to illustrate a state of the buckle according to the present invention being engaged with the strap-connecting element.
Figure 5:
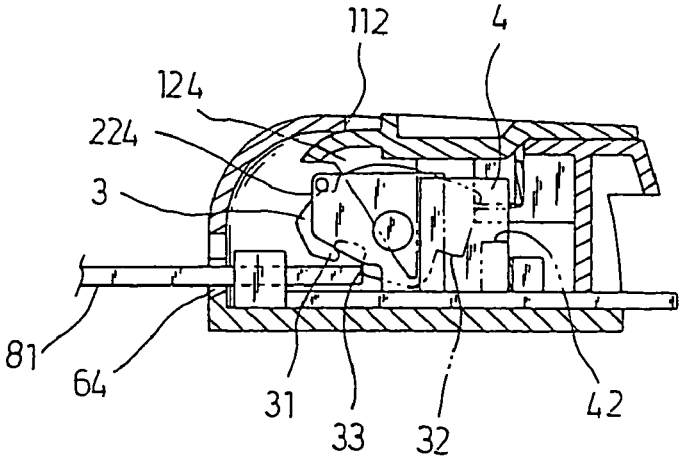
FIG. 5 is similar to FIG. 4 except illustrating a state of the buckle according to the present invention being disengaged with the strap-connecting element

As shown in FIGS. 4 and 5, finally, the first shell unit 1 is mounted on and fixed together with the second shell unit 2 by hot melting, snapping, screwing, or other mechanical ways so as to complete the buckle 9 for straps according to the present invention. In the meantime, the two guiding tabs 124 of the releasing piece 12 are respectively situated outside the two plates 224 of the seat 225 and in front of the moving element 4. The first elastic member 13 is situated in the cavity 35 of the locking element 3. The front end 52 of the pushing element 5 appears at the first snick 111 of the cap 11 and the first snick 111 is also matched together with the inlet 223 of the main body 22 to form an entrance 64 of the buckle 6.

An arc strap-connecting element 8 has a tongue 81 at the central portion thereof, a protuberance 82 on the tongue 81, and a receptacle 83 in the tongue 81.

When the tongue 81 of the strap-connecting element 8 is inserted into the entrance 64 of the buckle 9 for straps, the tongue 81 slides along the inlet 223 of the main body 22 and further pushes against the shoulder 33 of the locking element 3. Then, the locking element 3 is pivotally rotated counter-clockwise, as shown in FIG. 4, with respect to the pivotal pin 62 to the extent that the latch 31 downwardly moves into the receptacle 83 in the tongue 81 and locks the strap-connecting element 8. In the meanwhile of the latch 31 being downwardly rotated, the ledge 32 of the locking element 3 is upwardly rotated so that the gap between the ledge 32 and the main body 22 is getting larger enough to allow the spacer 42 of the moving element 4, which is forwardly pushed by the third elastic element 63, to situated under the ledge 32 of the locking element 3 and the latch 31 firmly locks the tongue 81. Besides, at this time, the protuberance 82 of the strap-connecting element 8 also abuts against the front end 52 of the pushing element 5. Because the main body 22 can be connected with a strap (not shown) at the slit 221 and the strap-connecting element 8 can also be connected to at least a strap, the buckle 9 for straps of the present invention has the function of connecting a plurality of straps.

When it is desired to separate the strap-connecting element 8 from the buckle 9 for straps, the only thing which is needed to do is to put a finger on the recess 122 or flange 121 of the releasing piece 12 and then to push the releasing piece 12 to backwardly slide relative to the cap 11. In the meanwhile, the moving element 4 is pushed at the guiders 41 thereof by the guiding tabs 124 of the releasing piece 12 and backwardly moves until the spacer 42 of the moving element 4 escapes from the ledge 32 of the locking element 3, that is, the spacer 42 is behind the ledge 32. Hence, the locking element 3 can be pivotally rotated clockwise, as shown in FIG. 5, under the action of the restoration force of the second elastic element 61. In other word, the ledge 32 of the locking element 3 is pivotally rotated downwardly and the latch 31 is pivotally rotated upwardly. When the latch 31 of the locking element 3 escapes from the receptacle 83 in the tongue due to upwardly rotating, the strap-connecting element 8 is sprung out of the buckle 9 for straps by means of the restoration force of the pushing element 5 exerting to the protuberance 82 of the strap-connecting element 8.

When the finger is removed from the releasing piece 12 or the releasing piece 12 is not exerted by any other external force, the releasing piece 12 is forwardly moved to the position that the flange 121 abuts against the front edge which defines the perforation 112 again by the restoration of the first elastic member 13. At the same time, due to the restoration of the third elastic member 63, the moving element 4 is pushed and forwardly moves. However, because the gap between the ledge 32 of the locking element 3 and the main body 22 is smaller or even there exits no gap, the spacer 42 of the moving element 4 cannot slide into the gap or under the ledge 32. In other word, the spacer 42 is blocked by the locking element 3 and situated behind the locking element 3 in order that the latch 31 of the locking element 3 is kept in a state of being opened.

This invention has been disclosed in terms of specific embodiments. It will be apparent that many modifications can be made to the disclosed structures without departing from the invention. Therefore, it is the intent of the appended claims to cover all such variations and modifications as come within the true spirit and scope of this invention.

What is claimed is:

1. A buckle for belts for connecting a strap-connecting element, the buckle comprising:

a first shell unit having a releasing piece;

a second shell unit having a first end and a second end opposing the first end connected to the first shell unit and defining an entrance at said first end together with the first shell unit, the second shell unit further having a slit at said second end for connecting a belt and a seat situated between the entrance and the slit;

a locking element being pivotally connected to the seat of the second shell unit and having a latch adjacent the entrance, a ledge extending towards the slit, and a shoulder formed between the latch and the ledge;

an elastic element being provided at the seat for repositioning the locking element;

a moving element being movably installed between the seat and the slit such that the moving element is able to slide relative to the seat; and the buckle being designed such that when the strap-connecting element is inserted into the entrance between the first shell unit and the second shell unit, the shoulder is pushed by the strap-connecting element so that the locking element is pivotally rotated to make the latch lock the strap-connecting element to enlarge a gap between said ledge and a main body of said second shell unit such that the moving element is moved in said gap to contact with the ledge so as to keep the locking element in a state of firmly securing the strap-connecting element; when the releasing piece of the first shell unit is actuated, the releasing piece cooperating with the moving element to move the moving element out of said gap away from the ledge such that said elastic element repositions said locking element to release the latch from the state of locking the strap-connecting element.

2. The buckle for belts as claimed in claim 1, wherein the buckle has an elastic element between the moving element and the second shell unit to cooperate the moving element to abut against the ledge.

3. The buckle for belts as claimed in claim 2, wherein the moving element has at least a guider for the seat to guide the movement of the moving element.

4. The buckle for belts as claimed in claim 3, wherein the moving element has a spacer for abutting the ledge of the locking element to make the locking element firmly lock the strap-connecting element.

5. The buckle for belts as claimed in claim 3, wherein the second shell unit has at least a stud for abutting one end of the elastic element.

6. The buckle for belts as claimed in claim 5, wherein the moving element has at least a tunnel for receiving another end of the elastic element.

7. The buckle for belts as claimed in claim 5, wherein the second shell unit comprises a base and a main body, and the main body further has at least an orifice for the passing of the at least the stud to secure the base and the main body together.

8. The buckle for belts as claimed in claim 5, wherein the second shell unit has at least a stake for connecting the pushing element.

9. The buckle for belts as claimed in claim 1, wherein the buckle further has a pushing element near the entrance to push the strap-connecting element out of the buckle.

10. The buckle for belts as claimed in claim 1, wherein the second shell unit further has a base and a main body, and the base has a plurality of costas to secure the main body.

11. The buckle for belts as claimed in claim 10, wherein the seat and the slit are at the main body.

12. The buckle for belts as claimed in claim 1, wherein the releasing piece has at least a guiding tab for cooperating the moving element to escape from the ledge.

13. The buckle for belts as claimed in claim 12, wherein the first shell unit further has a cap and a perforation in the cap, and the releasing piece is accommodated in the perforation.

14. The buckle for belts as claimed in claim 13, wherein the releasing piece has a protrusion at an end of the at least the guiding tab for securing the releasing piece and the cap together.

15. The buckle for belts as claimed in claim 13, wherein the first shell unit has an elastic element between the cap and the releasing piece for reposition of the releasing piece.

16. The buckle for belts as claimed in claim 1, wherein the seat further comprises two parallel plates, and the buckle further has a pin for pivotally connecting the locking element to the two plates.

17. The buckle for belts as claimed in claim 16, wherein the buckle further has an elastic element at the seat for reposition of the locking element.

* * * * *